US011014219B2

(12) United States Patent
Sugarman

(10) Patent No.: US 11,014,219 B2
(45) Date of Patent: May 25, 2021

(54) HIGH TORQUE TOOL ASSEMBLY AND SYSTEM FOR LOOSENING A TORQUE RESISTANT THREADED FASTENER AND SOCKET STABILIZER

(71) Applicant: Daniel Sugarman, Mooresville, SC (US)

(72) Inventor: Daniel Sugarman, Mooresville, NC (US)

( * ) Notice: Subject to any disclaimer, the term of this patent is extended or adjusted under 35 U.S.C. 154(b) by 417 days.

(21) Appl. No.: 15/869,689

(22) Filed: Jan. 12, 2018

(65) Prior Publication Data

US 2019/0217451 A1 Jul. 18, 2019

(51) Int. Cl.

| | |
|---|---|
| ***B25B 13/48*** | (2006.01) |
| ***B25B 23/00*** | (2006.01) |
| ***B25G 1/00*** | (2006.01) |
| ***B25B 13/06*** | (2006.01) |

(52) U.S. Cl.

CPC ..... *B25B 13/48* (2013.01); *B25B 13/06* (2013.01); *B25B 23/0007* (2013.01); *B25B 23/0021* (2013.01); *B25B 23/0035* (2013.01); *B25B 23/0085* (2013.01); *B25G 1/005* (2013.01)

(58) Field of Classification Search

CPC ... B25B 13/48; B25B 23/0035; B25B 13/065; B25B 13/06; B25B 13/04; B25B 23/0007; B25B 23/0021; B25B 23/0085; B25G 1/005

USPC ..... 81/121.1, 437, 439, 177.2

See application file for complete search history.

(56) References Cited

U.S. PATENT DOCUMENTS

| | | | | | |
|---|---|---|---|---|---|
| D45,165 | S * | 1/1914 | Warren | D8/21 | |
| D245,395 | S * | 8/1977 | Cognevich | D8/70 | |
| 4,436,005 | A * | 3/1984 | Hanson | B25B 13/481 | 81/177.75 |
| D316,363 | S * | 4/1991 | Lisenbee | D8/27 | |
| 5,433,356 | A * | 7/1995 | Russell | B25B 1/24 | 224/519 |
| 5,438,894 | A * | 8/1995 | Pearce | B25B 23/0021 | 81/124.7 |
| 5,568,757 | A * | 10/1996 | Lewis | B25B 15/001 | 81/177.2 |
| 5,950,507 | A * | 9/1999 | Wolfe | B25B 21/007 | 81/177.2 |
| 6,035,747 | A * | 3/2000 | Valela | B25B 23/0021 | 81/177.2 |
| 6,112,625 | A * | 9/2000 | Turtle | B25B 23/0021 | 81/177.1 |
| 6,913,277 | B2 * | 7/2005 | Mrofka | B60D 1/52 | 280/491.5 |
| 7,044,028 | B1 * | 5/2006 | Lozano | B25B 13/461 | 81/177.1 |
| 7,114,418 | B1 * | 10/2006 | Allen | B25B 13/48 | 81/439 |

(Continued)

*Primary Examiner* — Joseph J Hail
*Assistant Examiner* — Arman Milanian
(74) *Attorney, Agent, or Firm* — Mark DiPietro

(57) ABSTRACT

A tool and system for loosening or removing a torque resistant threaded fastener assembly. The system can be used with a bench receiver or vehicle mounted receiver and can be used to loosen "frozen" threaded fastener assemblies. The orientation of the components enables a user to place sufficient torque on a "frozen" threaded fastener. In this way the system enables the user to remove or disassemble a corroded combination (e.g.) a corroded or rusted nut and bolt.

5 Claims, 4 Drawing Sheets

(56) References Cited

U.S. PATENT DOCUMENTS

| | | | | |
|---|---|---|---|---|
| 7,252,022 | B1 * | 8/2007 | Losee | B25B 13/102 81/124.5 |
| 8,820,196 | B1 * | 9/2014 | Kennedy | B25B 23/0035 81/177.2 |
| 2010/0050818 | A1 * | 3/2010 | Rogers | B25B 23/0028 81/60 |
| 2014/0069237 | A1 * | 3/2014 | Vigil | B60B 29/003 81/124.4 |

* cited by examiner

HIGH TORQUE TOOL ASSEMBLY AND SYSTEM FOR LOOSENING A TORQUE RESISTANT THREADED FASTENER AND SOCKET STABILIZER

FIELD

The claimed tool assembly and system tool for disassembling used threaded components. Any corroded or rusted assemblies using a threaded fastener that is resistant to removal or disassembly can be successfully resolved. The claimed tool assembly and system articles can be used to loosen a rusted or corroded torque resistant threaded fastener and nut. One focus is a combination of a bolt and a complementary threaded member such as a nut.

BACKGROUND

A common problem in mechanical work is a fastener assembly that cannot easily be removed. Rapid disassembly and assembly of components during maintenance or repair is important in both commercial and do it yourself work. Do-it-yourself mechanics use hand powered wrenches of various designs. These impose continuous torque on a fastener but typical cannot place much more than 200 ft.-lbs. torque. Commercial mechanical shops use impact wrenches for quick disassembly. Impact wrenches impose intermittent torque on a fastener and, depending on manufacturer, typically provide about 230-800 ft.-lbs. torque.

In the repair or maintenance of many mechanical assemblies, a worker can encounter a "frozen" bolt in combination with a complementary threaded member such as an assembly held with a nut and bolt. A "frozen" fastener (e.g., a corroded or rusted nut or bolt) is one such that the environment of use of the nut and bolt has caused significant corrosion, rusting or other chemical change in the surface of the fasteners, such that the bolt assembly resists the application of even substantial amounts of torque for initiating rotation with respect to the complementary threaded member and subsequent removal, disassembly or reassembly without damage. Often, for economic considerations, the re-use of the nut and bolt is important since either the nut or bolt cannot be obtained on the marketplace or is cost prohibitive. During maintenance or repair, the amount of torque required for rotation of a nut with respect to the bolt or threads can be such that the torque applied by the common tools such as an ordinary wrench or ratchet socket and handle is insufficient to rotate the bolt with respect to the complementary threaded member. Such a torque can easily exceed 800 ft.-lbs. torque and can result in the mechanical failure of the fastener.

Considering this problem, a substantial need exists for a tool as a part of a system for frozen nut removal that can significantly increase the amount of continuous torque that can be applied to a nut frozen on a thread, such that the nut can be removed without damage to the nut thread or the nut and bolt assembly. Torque levels in the range of 400-1500 ft.-lbs. torque may be required.

BRIEF DESCRIPTION

A tool and system for loosening a torque resistant fastener assembly is disclosed. The basic elements are a receiver that is fixedly mounted. Torque levels in the range of 400-1500 ft.-lbs. torque can be achieved. I have found an insert member that can be inserted into a correspondingly shaped receiver that can be used in removal of a complementary threaded member from a threaded bolt. The insert member has a body shaped for insertion into common receiver profiles. The complementary shape of the insert with the receiver interior holds that insert stable when torqued. The insert body further comprises a first socket drive and a second socket drive. These socket drives can be and are preferred to be sized for different drive sockets or tools. The insert body can have an aperture that can receive a pin that cooperates and fixes the insert within a corresponding aperture and receiver. The insert body is fixed in place in the receiver during use.

In use, the insert body is fixed and mounted into a receiver by inserting the insert body profile into a corresponding receiver opening. The insert body is fixed in place using a mounting pin.

Onto the drive of insert body is placed a socket drive. Into the socket is placed the frozen bolt assembly. The threaded body can be mounted into the socket separately or in conjunction with any object in which it can be mounted or otherwise assembled. Onto the frozen bolt assembly is placed a second socket. The first socket and second socket are assembled with the nut and bolt, such that one socket drives the nut and the second socket drives the bolt head or threaded body.

Onto the second socket is placed a cooperating tool with a lever arm such as a ratchet handle, which can have an arbitrarily long lever arm. The lever arm distance is selected such that the lever arm can apply an arbitrarily large amount of torque onto the threaded body, bolt head or nut or both, such that the resistance caused by the frozen nut, threaded body and bolt can be overcome by the torque initiating relative rotation of the bolt with respect to the nut and its subsequent removal.

In one embodiment is shown an insert body having a first drive and a second drive.

In another embodiment is shown a receiver having an insert body shaped opening.

In another embodiment is shown an assembly of the receiver, the insert body, two drive sockets, the frozen nut thread and bolt and an appropriately sized torque handle.

A "fastener assembly" in this disclosure includes a cylindrical threaded fastener rotatably inserted into the circular portion of a threaded receiver. An example of a fastener assembly is a bolt and nut. The terms frozen, corroded and rusted are roughly synonymous and refer to a fastener assembly that resists disassembly or removal.

The above summary of the present disclosure is not intended to describe each disclosed embodiment or every implementation of the present disclosure. The description that follows more particularly exemplifies illustrative embodiments. In several places throughout the application, guidance is provided through lists of examples, which examples can be used in various combinations. In each instance, the recited list serves only as a representative group and should not be interpreted as an exclusive list.

BRIEF DESCRIPTION OF THE DRAWINGS

The disclosure is illustrated by the following figures. These figures, materials, amounts, and procedures are to be interpreted broadly in accordance with the scope and spirit of the disclosure as set forth herein. The disclosure may be more completely understood in consideration of the following detailed description of various embodiments of the disclosure relating to the accompanying drawings, in which.

The figures are not necessarily to scale. Like numbers used in the figures refer to like components. However, it will be understood that the use of a number to refer to a component in a given figure is not intended to limit the component in another figure labeled with the same number.

DETAILED DESCRIPTION

Figure 1:
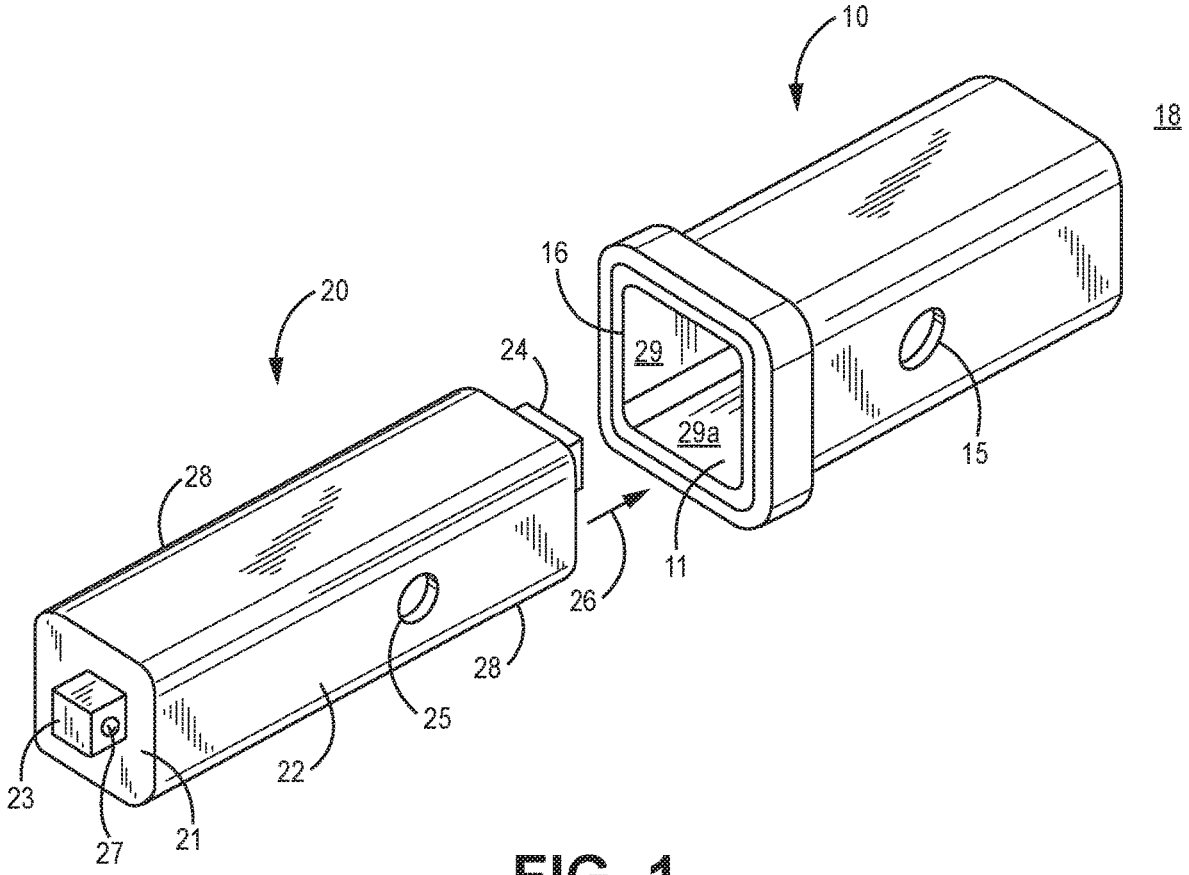
FIG. 1 is an isometric view of the insert body and receiver portion.

In a general sense, the present disclosure relates to a tool and system for loosening a torque resistant fastener assembly.

Oxidation and corrosion of fastening devices is a common and recurring problem. For example, fasteners, such as nuts and bolts are installed, and after years of use, when they need to be removed and/or replaced, such removal is prevented by the nut being "frozen" onto the bolt. To apply sufficient torque to loosen the bolt, the nut must be held steady. When a worker does not have a helper to hold the nut from rotating, he is unable to apply sufficient torque to loosen it. Even if a coworker is available, he may not be strong enough to hold the workpiece steady. Thus, a need exists to develop a mechanism by which the workpiece can be prevented from rotating. Optimally, the device should be simple to manufacture, easy to use, and compatible with other tools usually found in a well-equipped mechanic's armamentarium.

The high torque holding device fits such a need. It can be made from readily available and relatively inexpensive hot rolled steel or other high tensile suitable material, and it is designed to be used with standard wrenches that are commonly included in socket sets that are found in virtually all automotive facilities as well as in most of home workshops. Perhaps the biggest advantage of this device is that it relies, for its stability, upon an attachment that is found on most cars and trucks: a trailer hitch. By designing the high torque holding device to fit into a standard trailer hitch receiver, the device can be utilized by anyone whose car or truck has a trailer hitch.

The principle of the device is straightforward. The device fits securely into the trailer hitch, and a half-inch or three-quarter inch square drive extends from the free end. This square drive is then inserted into a socket which matches the size of the nut to be held. The user places another socket, with a long lever arm, on the bolt which is stuck on the nut, and sufficient torque can then be applied to loosen the nut. The presence of the massive vehicle to which the trailer hitch is mounted renders rotation of the nut impossible.

Occasionally the nut and bolt are so tightly stuck to each other that, rather than the nut coming loose, the torque exceeds the bolt's strength and the bolt breaks. This is not necessarily a disadvantage, as frequently the nut and bolt are expendable, and the desired piece can be salvaged and re-used after being released from the nut and bolt. In the claimed tool/assembly, torque is a rotational aspect of a force acting through a lever arm to rotate an object. The rotational action required by the assembly/tool on the frozen fastener to loosen/remove/disassemble the structure is obtained by placing sufficient torque on the handle 66 to cause the socket 65 to force the bolt 63 to rotate with respect to the nut 64. Torque is quantized as newton-meters (Nm) or foot-pounds (ft·lbs). One Nm is equal to 0.7376 ft·lbs. In the case that the fastener will mechanically fail before loosening and removal, the assembly/tool must be able to exert such a torsional force without failure.

The materials used in the assembly/tool as used must have sufficient structural modulus such that the assembly/tool can place sufficient torque on the fastener to accomplish its loosening, removal or disassembly or in other cases the mechanical failure of the fastener. The assembly/tool must not mechanically or structurally fail in the application of torque when in use. The assembly/tool must be made with sufficient size or dimensions in combination with sufficient modulus to act successfully. Typical receivers have either about 51 or 32 mm (2 or 1.25 inches) square internal opening and have a wall thickness of about 4 to 10 mm (0.15 to 0.4 inch). Such structures made from high strength steel have sufficient strength to withstand the torques necessary of successful operation. The inserts can be solid or hollow and can be made of high strength material such as steel. If solid, the inserts are sized to match the receiver openings. If hollow, the insert walls are sized to match or exceed the receiver walls. The sockets and socket drive lever arm are commercial materials and are typically engineered to provide sufficient torsional force to act successfully. The torsional strength of the materials used in the insert and receiver should meet or exceed that of the socket and lever arm. Structural steel such as medium carbon steel, medium carbon alloy steel and super strength alloy steels are sufficient with tensile capacity and shear capacity of 500 to 2000 Mpa (70 to 300 ksi).

The initial prototype of this device was machined from an 8-inch-long piece of 2-inch square hot rolled steel (ASTM A36). Sufficient metal was removed to form a ¾ inch square drive on one end, and a ½ inch square drive on the other. Depending on socket availability and the need for strength, a selection can be made to use either square drive. Most socket wrenches have a spring-loaded ball on the side of the square drive to prevent the socket from slipping off. The prototype did not contain these, but the plans for the final product do include that feature. Cost and weight considerations could result in manufacturing the device using a hollow square steel tube, with 3/32 inch or ¼ inch thick walls, which is a readily available material, rather than a solid 2-inch square bar. This would be cheaper and lighter than the prototype, although the manufacturing process would require that the square drive ends be welded onto the square tube.

The design of the device calls for a ¾ inch square drive at one end, and a ½ inch square drive on the other. Therefore, depending on the preference of the user, a half-inch or three-quarter inch square drive socket can be used. Additionally, the design calls for a ⅝-inch hole to be drilled transversely in the middle of the device, to accommodate the locking pin that is routinely used to secure a trailer hitch into a receiver.

DETAILED DESCRIPTION OF THE FIGURES

The disclosure will be further explained in greater detail by the figures that follow; however, the scope of this disclosure is not construed to be limited by the scope of these exemplary figures. The following is a table of Figure elements and reference numbering.

FIG. 1 shows the receiver 10 and the insert body 20 in orientation such that the insert body 20 can be placed within the receiver opening 16 in direction 26. The receiver 10 comprises a hollow member with a substantially square aspect that can be adapted to receive the insert body 20 with receiving surfaces 29 and 29*a*. The receiver 10 can be mounted on a vehicle or mounted in a shop on a bench or other mechanically stable installation placement 18. The receiver 10 has a receiver locking pin aperture 15 that is sized to correspond to the aperture 25 in the insert body 20. In FIG. 1, aperture 25 in insert body 20 is shown as formed in a hollow member aperture. The insert body 20 can be either a hollow body or a solid body. The square aspect 11 in the receiver 10 can be sized and configured to cooperatively mount the substantially square profile 22 of the insert body 20 such that it matches opening 16. The insert body 20 can have a socket drive 23 and a second socket drive 24 positioned on a flat face 21 of the insert body. The insert body can have its edges chamfered 28, such that it matches the profile of opening 16. The drives 23 and 24 can have detent portions such as spring-loaded balls 27 for fixedly retaining any socket installed onto the drives 24 of the insert body 20. The sockets not shown in FIGS. 1 through 5.

Figure 2:
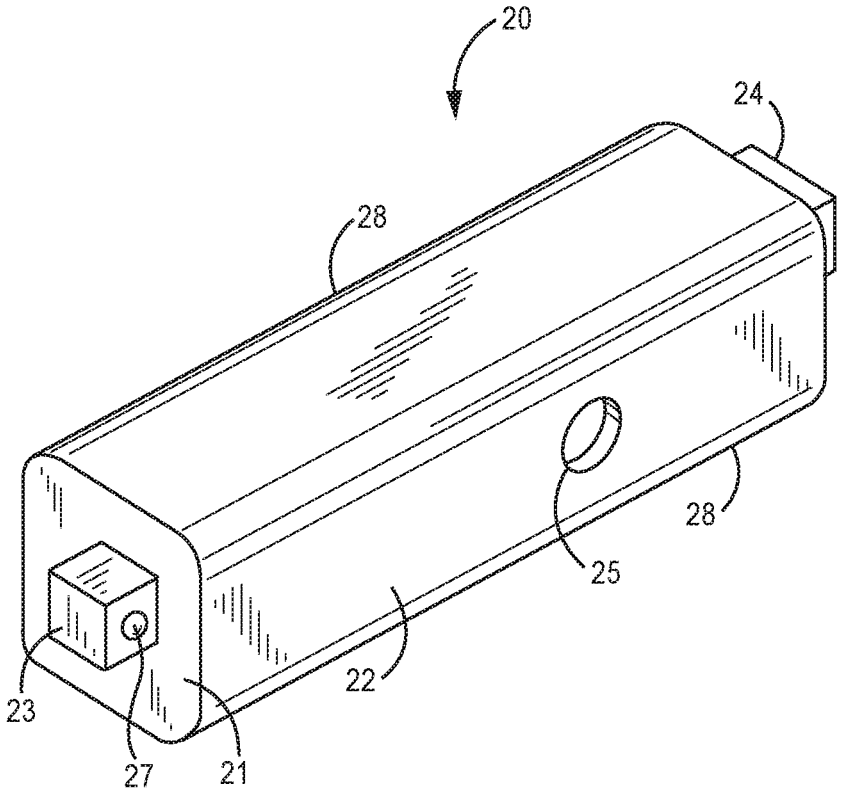
FIG. 2 is an isometric view of the insert body showing the drive portions and the locating aperture.

FIG. 2 is an isometric view of the insert body from FIG. 1. The insert body 20 has a flat face 22 and a chamfered edge 28 configured to fit into the opening 16 of the receiver. Aperture 25 is shown in a hollow body insert, whereas the insert can be either hollow or solid.

Figure 3:
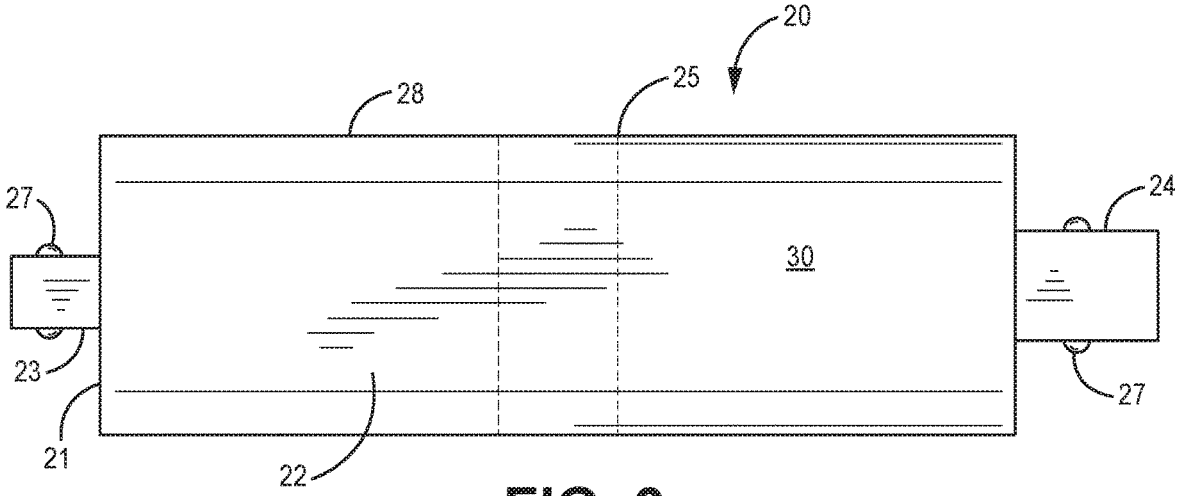
FIG. 3 is a top view of the receiver body of the insert body showing the drive portions and opposite ends of the insert body with the locking pin aperture shown in phantom.

FIG. 3 is a top view of the insert body. FIG. 3 shows the aperture 25 in a solid body in phantom. The aperture has an internal wall 30 defining the opening aperture 25. The top view of the insert body shows drives 23 and 24 of different standard ½ inch and ¾ inch dimensions, each having its own detent 27. The receiver has a surface 29 and at least one second surface 29*a* which are substantially planar, but fixed at a 90-degree angle to match the receiver shape.

Figure 4:
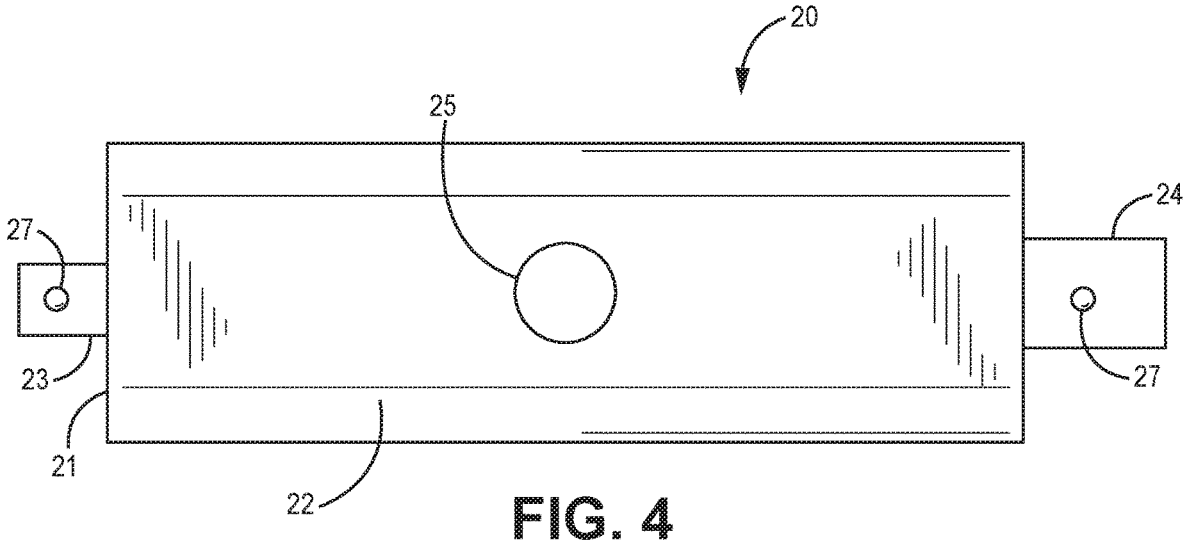
FIG. 4 is a side view of the insert body showing the locking pin insert. Please note that in FIG. 2, the aperture 25 is shown in a hollow body insert whereas in FIG. 3 the insert aperture is shown in a solid body insert.

FIG. 4 is a side view of the insert body showing the aperture 25. In the figures, the flat surfaces 23 and 24 of the ends of the drives of insert body are shown.

Figure 5:
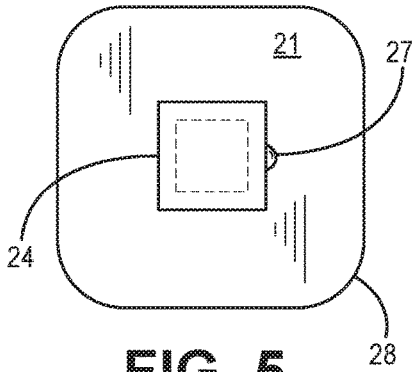
FIG. 5 is an end view of the insert body showing one drive and the insert in a solid body shown in phantom.

FIG. 5 is an end view of the insert body of FIG. 4 showing the chamfered edge 28, the larger drive 24, detent 27, and the smaller drive 23 (in phantom). FIGS. 3 and 4 also show the flat face surface 21 of the solid body of the insert body 20.

Figure 6:
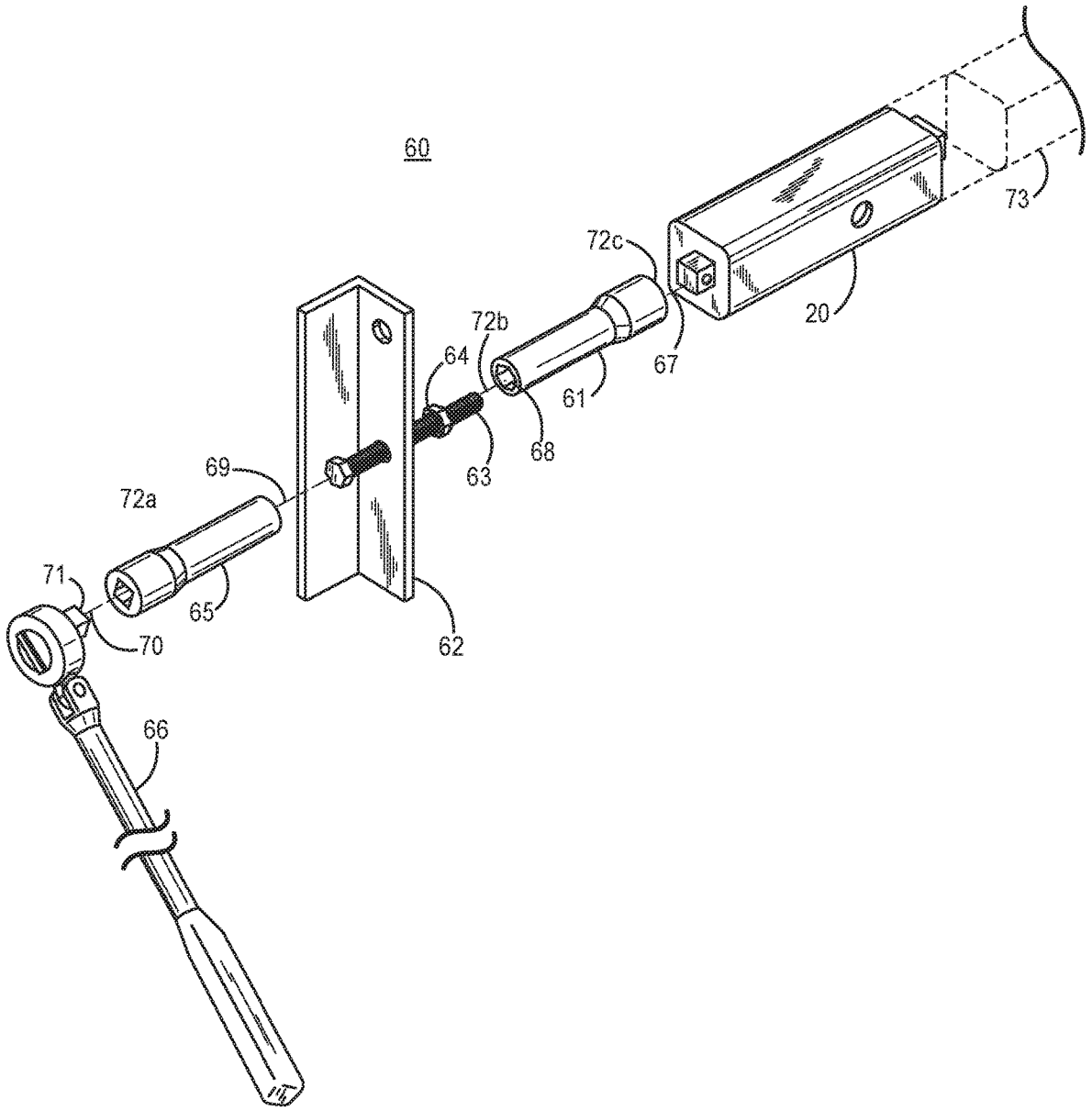
FIG. 6 shows an exploded view of the entire assembly of the insert, receiver, sockets lever arm and nut and threaded body.

FIG. 6 shows an exploded view of the entire assembly, which can be used to remove nut 64 from the threads 63 of a threaded body or bolt. In FIG. 6, the insert 20 is placed into the receiver 73 as shown. The receiver mount 73 (vehicle bench or otherwise mounted) is shown in phantom. Each socket 61 and 65 has drive apertures 72*a, b, c, d*. Insert 20 is shown with the socket 61, such that drive aperture 72*c* can be placed onto drive 23. Similarly, socket 61 is placed, such that the nut 64 can be placed into socket 61 at drive aperture 72*d* in the direction 68. Socket drive 71 is shown with the socket 65, such that drive aperture 72*a* can be placed onto drive 71. Similarly, socket 65 is placed, such that the bolt 63 can be placed into drive aperture 72*b* in the direction 69. The bolt 63 and nut 64 is shown in assembly with an object 62 that must be disassembled/removed from the nut and bolt assembly 63, 64. Socket 65 is shown similarly with a drive aperture that can be used cooperatively with the bolt 63. Socket 65 has a drive aperture 72*a* that can be mated cooperatively with a ratchet drive 71. The ratchet head 71 is assembled with a lever arm 66, which can be used to apply torque to the frozen bolt and nut when mounted in the assembled tool 60. Lever arm 66 can be selected having whatever arbitrary length is necessary for applying sufficient torque to the nut and bolt assembly to free and then rotate the frozen assembly.

TABLE

| References in Figures | | | |
|---|---|---|---|
| FIG. 1 | 10 | Receiver | Bench or Vehicle mounted |
| | 11 | Hollow member substantially square aspect | Member receive insert |
| | 15 | Receiver Locking Pin aperture (locking pin not shown) | Hollow body aperture |
| | 16 | Receiver Profile substantially square Female aspect | Insert profile shaped to receiver Receive insertion point |
| | 18 | Mount not shown | Bench/Vehicle |
| FIG. 1 and 2 | 20 | Isometric Insert Profile male aspect | Insert for receiver |
| | 21 | Flat face | |
| | 22 | Substantially square profile | Match internal shape of receiver |
| | 23 | Socket drive | Any commercial dimension |
| | 24 | Socket drive | Any commercial dimension |
| | 25 | Insert Locking Pin aperture (match receiver) | Can be aperture in hollow body insert or a solid body insert |
| | 26 | insert direction into receiver | Position insert |
| | 27 | Detent ball | Retain socket |
| | 28 | Edge (can be chamfered) | Match receiver profile if needed |
| | 29, 29a | Receiver mating surfaces | Fixes insert in place in receiver |
| FIG. 3, 4 and 5 | 30 | Solid/Not hollow | Optional sold or hollow body |
| | | Top view | Fig Insert 20 |
| | | Side view | Fig Insert 20 |
| | | end view | Fig Insert 20 |
| FIG. 6 | 20 | insert | Insert body |
| | 60 | Isometric overall Assembly (exploded) View | (Bench, Vehicle, or other foundational receiver base) |
| | 61 | First socket | On insert |
| | 62 | Article | |
| | 63 | Frozen Bolt | Fastener |
| | 64 | Frozen Nut | Threaded receiver |
| | 65 | Second socket | On fastener |
| | 66 | Ratchet and | handle |
| | 67 | Assembly direction | Socket |
| | 68 | Assembly direction | Socket |
| | 69 | Assembly direction | Other socket |
| | 70 | Assembly direction | Other socket |
| | 71 | Drive insert | Socket drive |
| | 72 a, b, c, d | Drive aperture | In sockets |
| | 73 | Receiver mount | (Bench, Vehicle, or other foundational receiver base) Shown in Phantom |

All scientific and technical terms used herein have meanings commonly used in the art unless otherwise specified.

The definitions provided herein are to facilitate understanding of certain terms used frequently herein and are not meant to limit the scope of the disclosure. The words "preferred" and "preferably" refer to embodiments of the disclosure that may afford certain benefits, under certain circumstances. However, other embodiments may also be preferred, under the same or other circumstances. Furthermore, the recitation of one or more preferred embodiments does not imply that other embodiments are not useful, and is not intended to exclude other embodiments from the scope of the disclosure.

The term "comprises" and variations thereof do not have a limiting meaning where these terms appear in the description and claims.

As used in this specification and the appended claims, the term "or" is generally employed in its sense including "and/or" unless the content clearly dictates otherwise.

"Include," "including," or like terms means encompassing but not limited to, that is, including and not exclusive.

The complete disclosure of all patents, patent applications, and publications cited herein are incorporated by reference. If any inconsistency exists between the disclosure of the application and the disclosure(s) of any document incorporated herein by reference, the disclosure of the application shall govern. The foregoing detailed description and examples have been given for clarity of understanding only. No unnecessary limitations are to be understood therefrom. The disclosure is not limited to the exact details shown and described, for variations obvious to one skilled in the art will be included within the disclosure defined by the claims.

Unless otherwise indicated, all numbers expressing quantities of components, molecular weights, and so forth used in the specification and claims are to be understood as being modified in all instances by the term "about." Accordingly, unless otherwise indicated to the contrary, the numerical parameters set forth in the specification and claims are approximations that may vary depending upon the desired properties sought to be obtained by the present disclosure. At the very least, and not as an attempt to limit the doctrine of equivalents to the scope of the claims, each numerical parameter should at least be construed considering the number of reported significant digits and by applying ordinary rounding techniques.

Notwithstanding that the numerical ranges and parameters setting forth the broad scope of the disclosure are approximations, the numerical values set forth in the specific examples are reported as precisely as possible. All numerical values, however, inherently contain a range necessarily resulting from the standard deviation found in their respective testing measurements.

All headings are for the convenience of the reader and should not be used to limit the meaning of the text that follows the heading, unless so specified.

What is claimed is:

1. A tool adapted and configured to be inserted into a receiver mounted on a vehicle or bench, the receiver having a square opening of 2 inches or 1.25 inches and a length of 1 to 12 inches consisting of an elongated member with a substantially square cross section having a first end and a second end, each end having a flat face, wherein, positioned at opposite ends of the member are substantially square socket drive portions that are positioned on the flat faces of the elongated member and are sized to receive the substantially square driver portion of a socket, wherein the drive portions have different square dimensions; and wherein the length of the member is about 1 to 12 inches, the square cross section of the member is 2 by 2 or 1.25 by 1.25 inches matching the receiver, the cross section of the first square driver portion is 0.5 by 0.5 inches and the cross section of the second square driver portion is 0.75 by 0.75 inches and the tool can be used to manually apply a torque of 230-800 ft.-lbs. to a corroded fastener using, a square driver mounted socket.

2. The tool of claim 1 wherein the square driver portion comprises a detente.

3. The tool of claim 1 wherein the tool has a hollow body.

4. An assembly comprising a hitch receiver and the tool of claim 1.

5. A method of removing a corroded nut from a bolt in a corroded assembly comprising inserting the tool of claim 1 into a receiver, placing a socket on the tool, inserting a nut or bolt into the socket forming an assembly and applying sufficient torque to the assembly to remove the nut from the bolt.

* * * * *